US009592888B1

(12) United States Patent
Bracho et al.

(10) Patent No.: US 9,592,888 B1
(45) Date of Patent: Mar. 14, 2017

(54) DAMPENED PIVOTING LIFT DEVICE FOR A MULTI-LINE LIFT POINT CONFIGURATION

(71) Applicants: Pedro Bracho, Lynn Haven, FL (US); Bryan John, Panama City Beach, FL (US)

(72) Inventors: Pedro Bracho, Lynn Haven, FL (US); Bryan John, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 231 days.

(21) Appl. No.: 14/245,373

(22) Filed: Apr. 4, 2014

(51) Int. Cl.
*B63B 27/00* (2006.01)
*B63B 27/36* (2006.01)

(52) U.S. Cl.
CPC ..... *B63B 27/36* (2013.01)

(58) Field of Classification Search
CPC ... B63B 27/36; B63B 21/66; B63B 2027/165; B63G 8/001; B66C 13/02; B66C 13/04; B66C 13/06; B66C 13/10
USPC ..... 414/137.7; 294/66.1; 114/44, 51; 405/158
See application file for complete search history.

(56) References Cited

U.S. PATENT DOCUMENTS 1,590,020 A * 6/1926 Golden ..... B63C 7/16 294/111
1,731,674 A * 10/1929 Lutz ..... B63C 7/16 114/51
2,372,347 A * 3/1945 Watson ..... B63C 7/16 114/51
3,367,299 A * 2/1968 Sayre, Jr. ..... B25J 19/023 114/51
3,986,745 A * 10/1976 Langguth ..... B63C 7/20 114/55
4,009,635 A * 3/1977 Munro ..... B64D 1/22 244/137.4
4,516,517 A * 5/1985 Ayers ..... B63B 27/36 114/244
4,869,149 A * 9/1989 Cavanagh ..... B63B 27/36 114/244
5,253,606 A * 10/1993 Ortelli ..... B66C 13/02 114/259
6,109,199 A * 8/2000 Wallach ..... B63B 27/36 114/254
7,028,627 B2 * 4/2006 Bouchaud ..... B63B 27/36 114/259

(Continued)

*Primary Examiner* — Michael McCullough
*Assistant Examiner* — Lynn Schwenning
(74) *Attorney, Agent, or Firm* — James T. Shepherd

(57) ABSTRACT

A lifting device to retrieve a marine vehicle comprises a lifting arms portion pivotally connected with a vehicle capture portion. The lifting arms portion and the vehicle capture portion rotate independently of each other. The vehicle capture portion comprises a capture connector having a probe for insertion into a latch opening in the vehicle to thereby attach the vehicle to the lifting device. The lifting arras portion further comprises two lifting arms and two vehicle pads for engaging the vehicle when it is captured. As the vehicle rolls during recovery operations, springs disposed between the vehicle capture portion and lifting arms portion dampen rotational motion. Lift line connections are provided on distal ends of the vehicle capture portion, and the lifting arms.

9 Claims, 8 Drawing Sheets

(56) References Cited

U.S. PATENT DOCUMENTS

| | | | | |
|---|---|---|---|---|
| 2009/0208299 | A1* | 8/2009 | Courvoisier | A61B 17/16<br>407/49 |
| 2011/0192238 | A1* | 8/2011 | Jones | G01N 1/02<br>73/863.21 |
| 2011/0254302 | A1* | 10/2011 | Imlach | B66C 1/30<br>294/119 |

* cited by examiner

DAMPENED PIVOTING LIFT DEVICE FOR A MULTI-LINE LIFT POINT CONFIGURATION

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to lifting devices and more specifically in one possible embodiment to a dampened one-axis pivoting lifting device for a multi-line lift configuration.

(2) Background of the Invention

In the maritime field, a lifting device is often used to grab or capture water vehicle such as unmanned underwater vehicles. The lifting device is typically a rigid frame that is clamped to the vehicle. The rigid frame provides lifting points to which multiple lift cables can be attached. Once the frame is secured to the underwater vehicle, a ship-borne crane lifts the water vehicle from the water.

However, the lifting process often takes place in a dynamic fluid environment that may comprise wind and waves that may cause the ship-borne crane and/or water vehicle to move relative to each other. In this environment, the water vehicle, which may be relatively heavy, is likely to experience rolling movement along the axis of the vehicle.

As the vehicle being lifted rolls in the water environment, some lines slacken while at some point during the roll, one or more other lines suddenly become taut. When these lift lines suddenly become taut, they must resist the entire weight and momentum of the vehicle that suddenly comes to bear. These dynamics can snap the lift lines during the recovery operation and/or cause damage to the vehicle as the frame engages the vehicle at stress points. Accordingly, this type of suddenly applied stress may be referred to herein as a "snap load".

If a lift line breaks or if there is damage to the frame or vehicle due to a snap load, the lifting operation can be significantly prolonged. Equipment damage may occur to both the vehicle and lifting device. Moreover, breaking lines and/or equipment can potentially lead to unsafe environment for workers assisting in the capture of the underwater vehicle.

Consequently, those of skill in the art will appreciate the present invention, which addresses the above and/or other problems.

SUMMARY OF THE INVENTION

Accordingly, it is an object of the present invention to provide an improved lifting device for a multi-line lift configuration.

Another object of the present invention is to provide an improved lifting device for a multi-line lift configuration that significantly eliminates roll-induced snap loads created by a water vehicle during recovery in a dynamic fluid environment.

Another possible object of the invention is to provide a lifting device for a multi-line lift configuration that contains portions that rotate with respect to each other for spring dampening of vehicle movement during recovery in a water environment.

In accordance with the disclosure, the present invention provides a lifting device for a multi-point lift line configuration to capture a water vehicle. The lifting device comprises a vehicle capture portion and a lifting arms portion. The lifting arms portion may comprise two lifting arms correctable with at least two lift lines of the multi-point lift line configuration. At least one spring is connected to the two lifting arms. The lifting arms portion farther comprises at least two vehicle pads positioned for engagement with the vehicle whereby the spring is positioned between the vehicle capture portion and the lifting arms portion. The vehicle capture portion interfaces (rigidly) with the vehicle. So as the vehicle rolls, this portion rolls as well. When it rolls, the springs are compressed because the lifting arms portion is held level by the lift lines. In one preferred embodiment, the spring is positioned between the vehicle capture portion and the lifting arms portion. The vehicle capture portion interfaces (rigidly) with the vehicle. So as the vehicle rolls, this portion rolls as well. When it rolls, the springs are compressed because the lifting arms portion is held level by the lift lines.

A pivot connection is provided between the vehicle capture portion and the lifting arms portion.

In one embodiment, a capture connector further comprises a probe mounted to the vehicle capture portion that extends outwardly from the vehicle capture portion at a position for engaging the vehicle.

The vehicle capture portion may further comprise at least one lift line connection point positioned at a distal end from the lifting arms portion. The lift line connection point is operable for connection with at least one lift line of the multi-point lift line configuration.

The two lifting arms are positioned on the lifting arms portion to extend outwardly from the vehicle on opposite sides when in position with the capture connector secured to the vehicle. In one embodiment, the pivot connection permits relative rotation between the vehicle capture portion and the lifting arms portion only along one axis. The vehicle capture portion is preferably elongate in a direction of the one axis.

In another embodiment, a method is provided for making a lifting device for a multi-point lift line configuration to capture a vehicle. The method may comprise steps such as providing a vehicle capture portion with a capture connector operable to secure the vehicle capture portion to the vehicle and/or providing a lifting arms portion comprising two lifting arms that are connectable with at least two lift lines of the multi-point lift line configuration.

Other steps may comprise connecting a spring to each of the two lifting arms and pivotally connecting the vehicle capture portion to the lifting arms portion.

The method may further comprise positioning at least two vehicle pads for engagement with the vehicle in response to compressing the spring.

The method may further comprise providing that the pivot connection permits relative rotation between the vehicle capture portion and the lifting arms portion only along one axis.

BRIEF DESCRIPTION OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The need for this invention arises when lifting a mass out of a dynamic fluid environment with a lift-line configuration which allows the lifting device complete freedom to roll up to a certain point wherein from that point a high stress is applied that comprises a snap load that is suddenly applied to the lift-line configuration.

Figure 1:
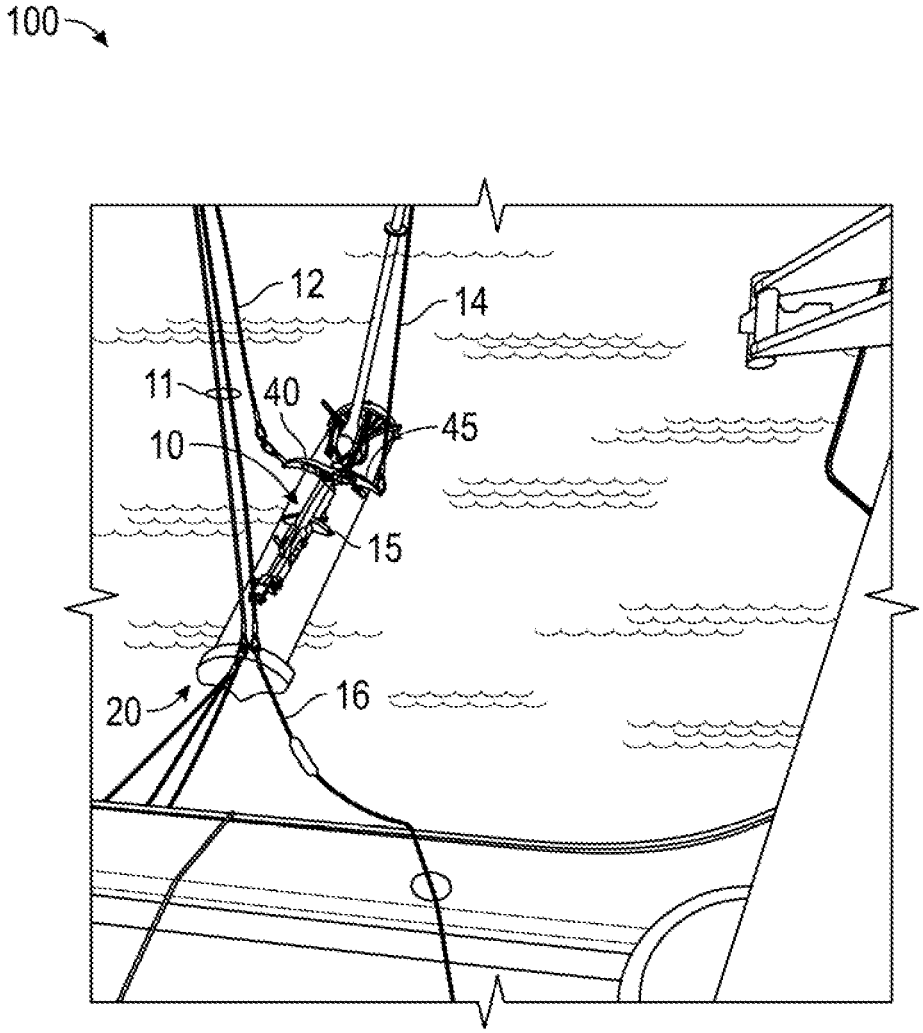
FIG. 1 is a perspective view depicting a vehicle being lifted from the water by a number of lift lines secured to a pivoting lifting device in accord with one possible embodiment of the present invention.
Figure 7:
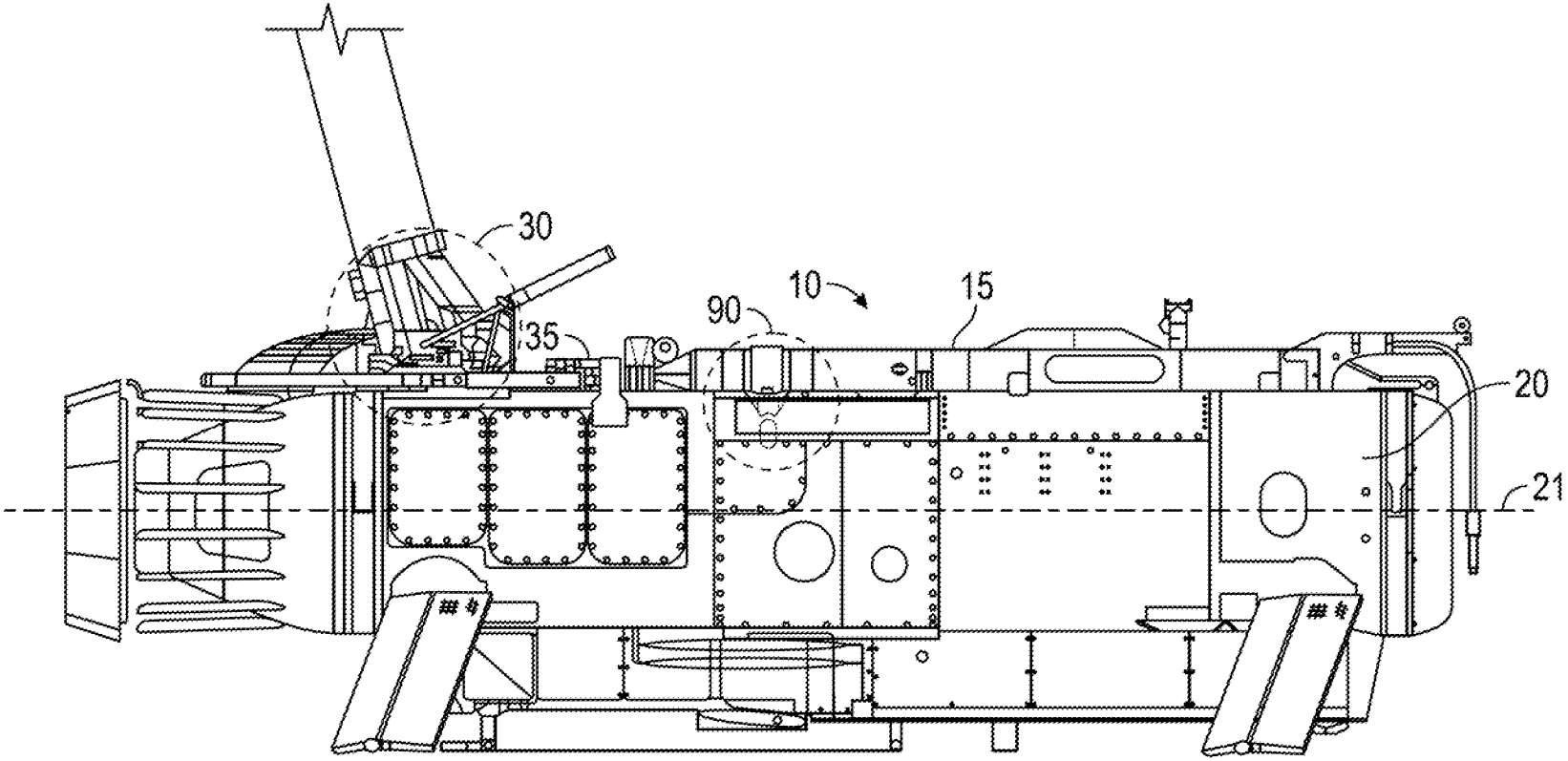
FIG. 7 is a side elevational view of a pivoting lifting device secured to a water vehicle in accord with one possible embodiment of the present invention.

Turning to FIG. 1, multi-line capture system 100 comprises lifting device 10, which is lowered onto vehicle 20. The weight of vehicle capture portion 15 of lifting device 10 presses a probe into vehicle 20, which then locks into vehicle 20, as discussed hereinafter in reference to FIG. 8. Vehicle capture portion 15 preferably has a length sufficient to extend along a substantial portion of the vehicle, as shown in FIG. 7.

Multiple lift lines are utilized with lifting device 10, which may comprise lift lines such as lines 12, 14, forward lift lines 11, and/or other lift lines and/or groups of lift lines. Lift line 12 attaches to arm 40 and lift line 14 attaches to arm 45. Accordingly, lift lines 12, 14 may be utilized to prevent or resist rolling of vehicle 20.

The lifting process requires that lift lines 12, 14 be slackened during capture, which allows lifting device 10 and vehicle 20 to begin to roll unrestrained. As the angle of the roil increases and/or as lift lines 12, 14 are tightened, the forces increase to resist rolling motion. However, in accord with the present invention, capture system 100 is designed to so that forces applied to the lift lines 12, 14 due to rolling of vehicle 20 increases more gradually. System 100 more gradually increases force to resist roll as one of lines 12 and 14 is more gradually tightened. In this way, the likelihood of sudden application of snap loads is greatly reduced or prevented. Vehicle 20 rolling motion is thereby better controlled without damage to lifting system 100 and/or the vehicle 20.

Figure 5:
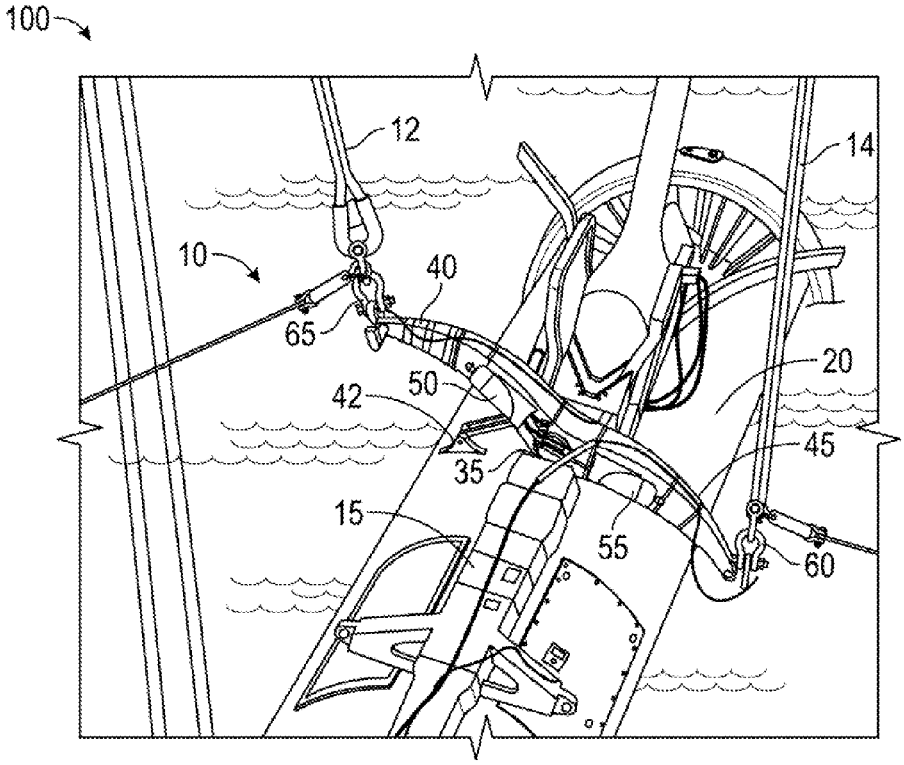
FIG. 5 is a perspective view of a vehicle being lifted from the water by a pivoting lifting device in accord with one possible embodiment of the present invention.

A more in depth view of multi-line capture system 100 is depicted in FIG. 5. However, as shown, the vehicle is rotated to create tension in lift line 12. When line 14 is tensioned, the vehicle should be rotated clockwise with respect to the lift arms 45/40. Lift line arm 40 connects with lift line 12 via clevis hitch 65. Lift line arm 45 connects with lift line 14 via clevis hitch 60. In this scenario, as vehicle 20 rolls in a clockwise direction, vehicle pad 42 contacts vehicle 20 and force is gradually applied to lift line 14 through a spring-loaded connection between lift line arm 45 and vehicle capture portion 15. Lifting device 10 also comprises pivot connection 35, which allows lift line arms 40, 45 to pivot with respect to vehicle capture portion 15.

Figure 2:
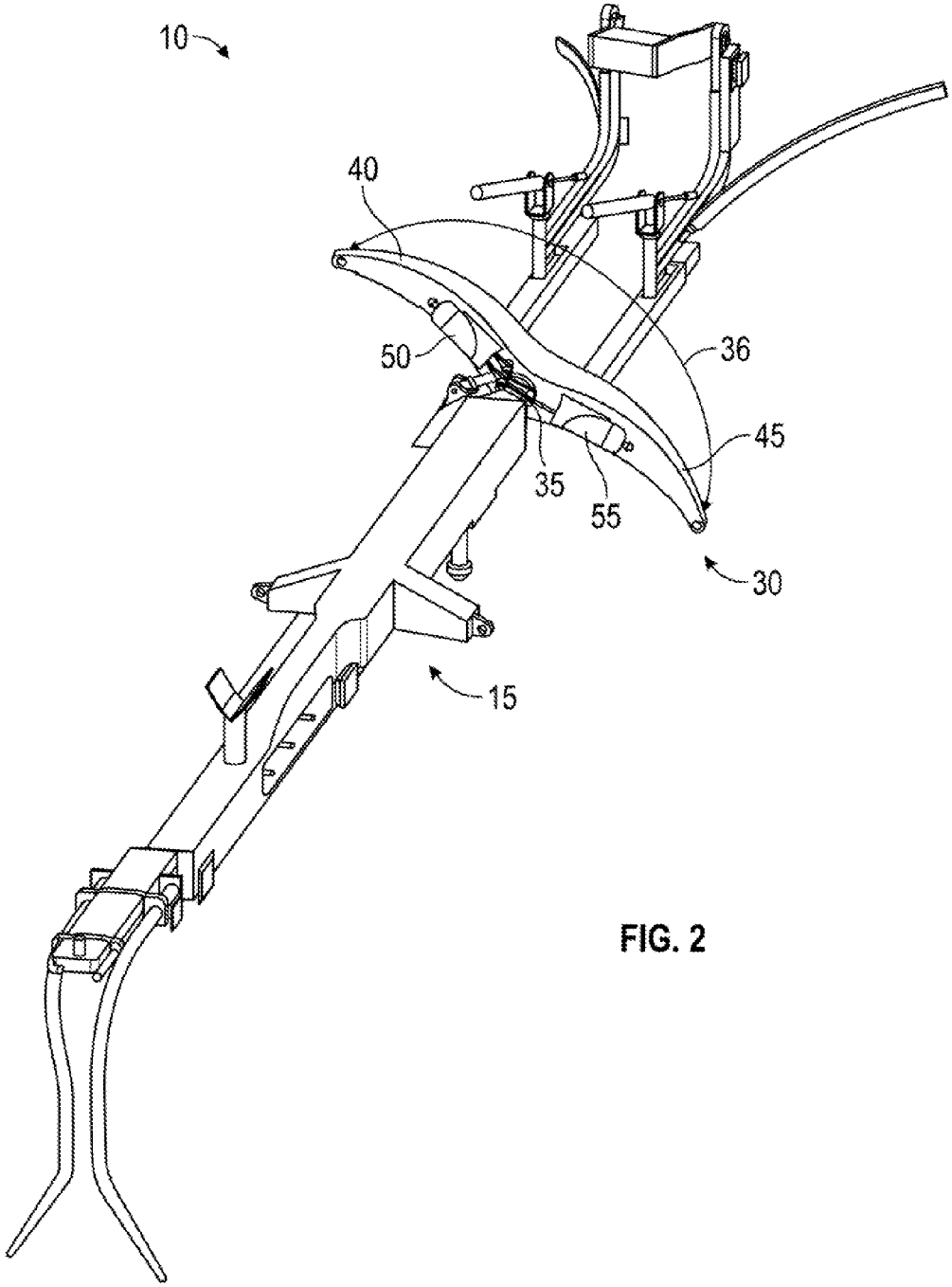
FIG. 2 is a perspective view of a pivoting lifting device with a lifting arms portion in a pivoted orientation with respect to a vehicle capture portion in accord with one possible embodiment of the present invention.

Turning to FIG. 2, there is shown vehicle capture portion 15 and lifting arms portion 30 of lifting device 10. Lifting arms portion 30 comprises lift-line interfacing arms 40, 45. Lifting arms portion 30 is interconnected with vehicle capture portion 15 via pivot connection 35 that allows pivotal or rotational motion therebetween along a single axis in two directions as indicated by arrow 36. In one embodiment, lifting arms portion 30 interfaces only with the corresponding lift lines 12, 14 connected at opposite ends thereof (see FIG. 3) and pivot connection 35 of vehicle capture portion 15. The vehicle capture portion 15 interfaces with the lifting arm (pivoting) portion and the vehicle. Vehicle capture portion 15 further comprises a capture connector 90 (see FIG. 3), discussed hereinafter with respect to FIG. 8, which secures vehicle capture portion 15 to vehicle 20 to thereby capture vehicle 20. Various types of appropriate capture connectors 90 known in the art may be utilized for connecting lifting device 10 to existing water vehicles.

In FIG. 2, vehicle capture portion 15 and lifting arms portion 30 are depicted in a pivoted position with respect to each other, which occurs when vehicle 20 rolls. Pivot connection 35 of lifting device 10 separates vehicle capture portion 15 and lifting arms portion 30 into two portions that can rotate independently of each other. Preferably, pivot connection 35 permits only rotation along a single axis that is parallel or generally parallel to axis 21 of vehicle 20 shown in FIG. 7.

Figure 3:
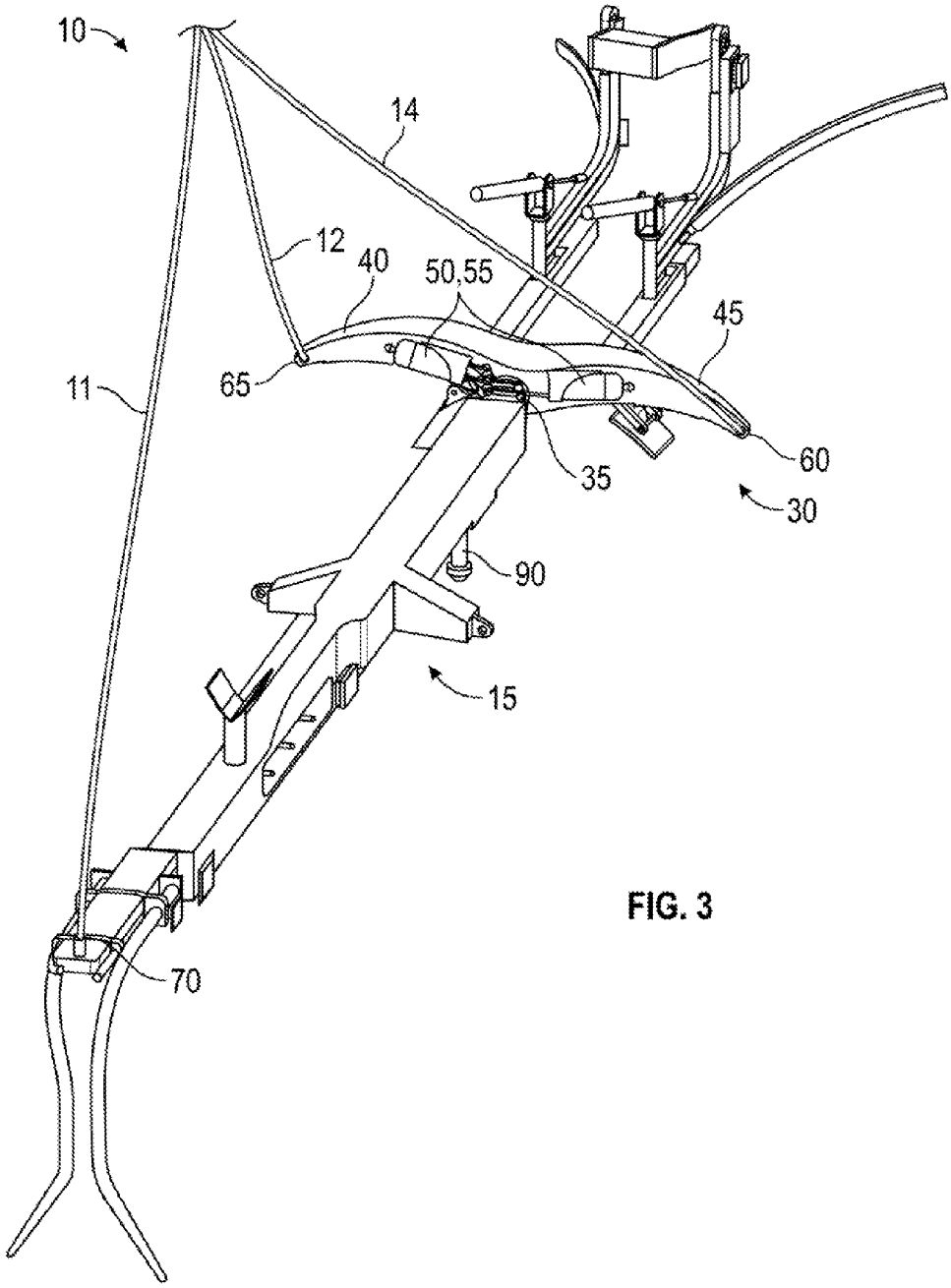
FIG. 3 is a perspective view of a pivoting lifting device in a zero-load position with a lifting arms portion in a non-pivoted orientation with respect to a vehicle capture portion in accord with one possible embodiment of the present invention.

FIG. 3 depicts lifting device 10 in a zero-load position, wherein vehicle capture portion 15 and lifting arms portion 30 are not pivoted with respect to each other, which occurs when vehicle 20 is in an upright position. In this embodiment, lifting device 10 is a three point device with essentially three lifting forces for application to three points 60, 65, and 70 as indicated by respective lift lines 14, 12, and 11. However, more than three cables may be utilized even though in this embodiment lifting device 10 is shown as a three point lift device. FIG. 1 shows a three point lift as well. In FIG. 1, line 16 is preferably a tag-line, used for side-to-side control, and not for lifting. Two forward lift lines 11 connect to the same lift-point. The present invention is intended to be a multipoint lifting device and is not limited to three lifting points and/or cables. For example only, another embodiment of the invention could comprise our lift lines and two pivoting arms.

Figure 6:
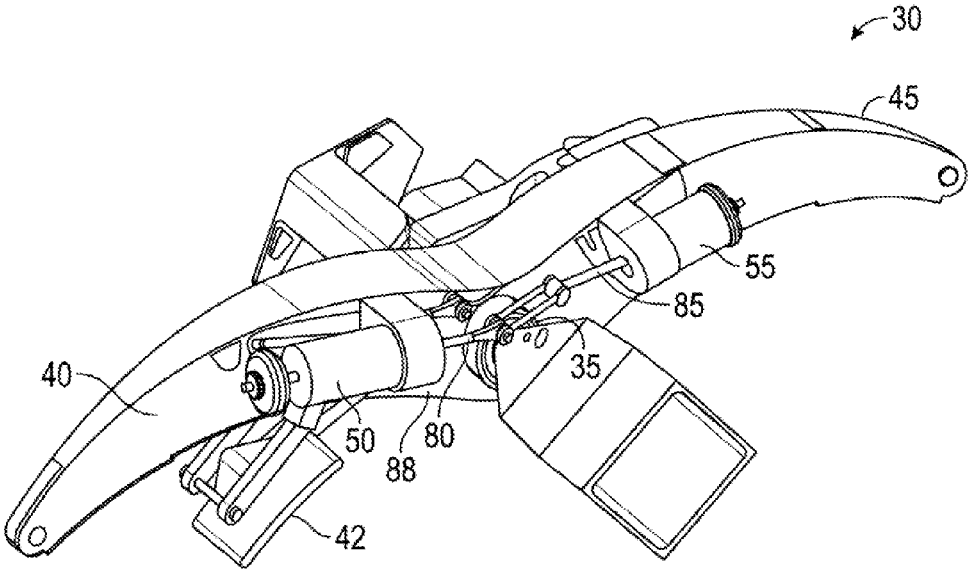
FIG. 6 is a perspective view, partially in cutaway, illustrating the lifting arms portion of a lifting device in accord with one possible embodiment of the present invention.

Referring now to FIG. 6, springs 50 and 55 control the rotation of lifting device 10 by gradually slowing (or dampening) the rolling motion of vehicle 20 and thereby preventing snap loads suddenly being applied to lift-lines 12, 14. As shown in FIG. 6, spring 55 is compressed, while spring 50 is not compressed. It will be noted that springs 50, 55 interface only between vehicle capture portion 15 and lifting arms portion 30; there are no springs between the pads 42, 47 (see, e.g., FIG. 4A) and the lifting arms 40, 45. In the example of FIG. 5, spring 55 is compressed, while spring 50 is not.

In FIG. 6, lifting arms portion 30 of lifting device 10 is depicted, partially in cut-away. Relative movement of lifting device 10 and vehicle 20 is controlled using springs 50, 55 to counteract rotation. Springs 50, 55 may comprise spring canisters or shock absorbers, as examples. Vehicle capture portion 15 (See FIG. 2-3) connects with lifting arms portion 30 at pivot connection 35. As vehicle capture portion 15 rotates relative to lift line arms 40, 45, one of springs 50, 55 is compressed via one of spring rods 80, 85 depending on the direction of the roll. The compression of springs 50, 55 stores a large amount of energy. This energy buildup slows the roil of the vehicle being recovered and eliminates snap-line loading of the lift lines. In one non-limiting embodiment, the springs 50, 55 are connected via rods 80, 85 between the lifting arms portion 30 and the vehicle capture portion 15.

The springs may be configured differently, may comprise more or fewer than two springs, and may or may not comprise rods 80, 85 as long as the springs are connected between lifting arms portion 30 and vehicle capture portion 15 so as to dampen the relative rotational movement therebetween.

FIGS. 4A through FIG. 4D illustrate vehicle 20 at various degrees of roll with respect to lifting arms portion 30 that may be experienced during a recovery operation. The interaction of lifting arms 40, 45 and pads 42, 47 of lifting arms portion 30 is discussed in connection with increasing amounts of roll of the vehicle 30.

Vehicle 20 is affixed to lifting device 10 by single point vehicle connection 90, which is discussed in more detail below and illustrated in FIG. 8. The relative position of single point vehicle connection point 90 on vehicle capture portion 15 is also shown in FIG. 3.

Figure 4A:
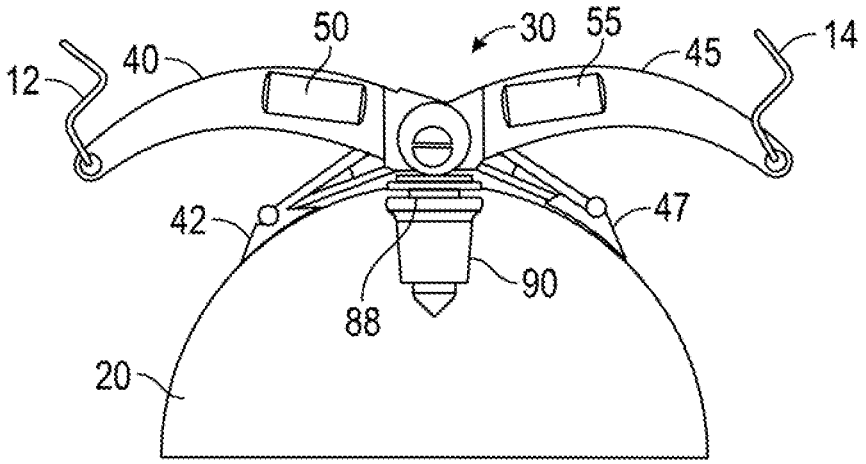
FIG. 4A is a cross-sectional diagram showing a water vehicle with attached pivoting lifting device with zero degrees of roll of the water vehicle and no pad contact in accord with one possible embodiment of the present invention.

In FIG. 4A, vehicle 20 is not rolling; i.e., it is in a zero degree roll, upright and stationary. In this position, lift lines 12, 14 are both relatively slack or have even loads applied. Lift line arms 40, 45 are both at relative equal positions with respect to vehicle 20. Vehicle pads 42, 47 are evenly spaced and may have little or no contact with vehicle 20.

Figure 4B:
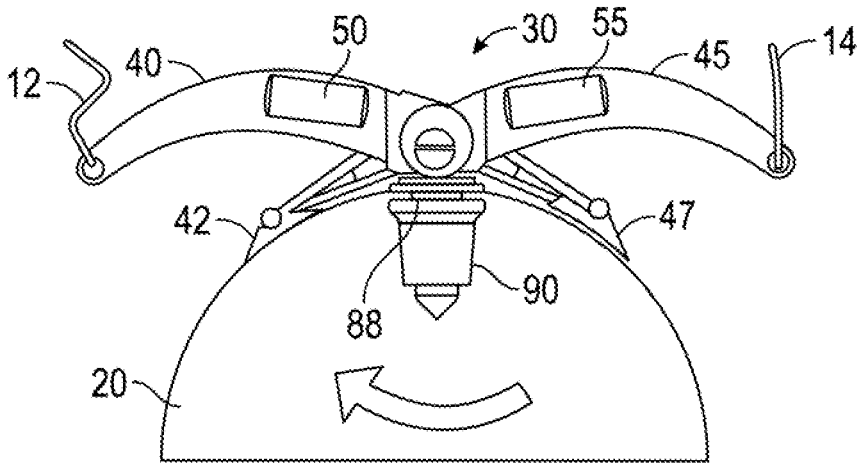
FIG. 4B is a cross-sectional diagram showing a water vehicle with attached pivoting lifting device with two degrees of roll in the direction of the arrow and initial pad contact with one pad in accord with one possible embodiment of the present invention.

In FIG. 4B, vehicle 20 experiences the first two degrees of an initial roll (e.g., in a clockwise direction as indicated by the arrow). Lift line 12 remains relatively slack, but lift line 14 may become more taught in reaction to the roll. Vehicle 20 makes contact with vehicle pad 42 and vehicle pad 47 may become, or remain, spaced away from vehicle 20.

Figure 4C:
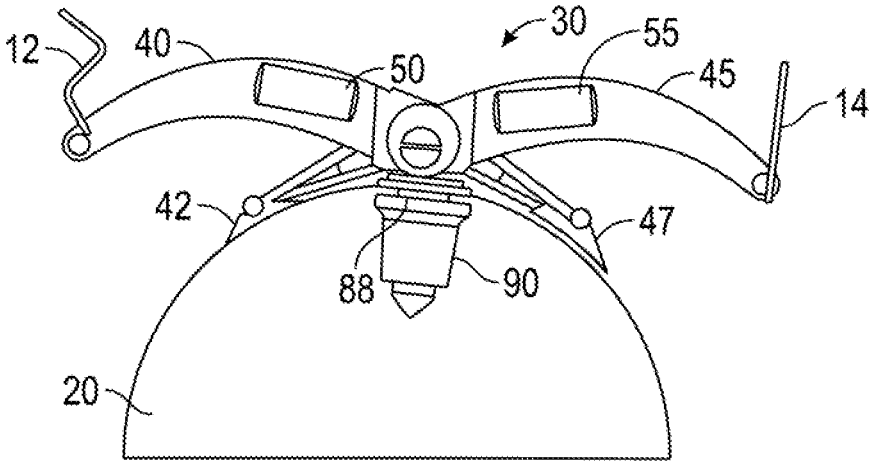
FIG. 4C is a cross-sectional diagram showing a water vehicle with attached pivoting lifting device with approximately five degrees of roll in the direction of the arrow. As noted above, the spring is not connected to the pad.

In FIG. 4C, lifting arms portion 30 pivots sufficiently with respect to vehicle capture portion 15 to provide initial spring compression of spring 55 as vehicle 20 experiences roll, which in one embodiment may be in the general range of five to ten degrees. Vehicle pad 42 further applies pressure to vehicle 20 through spring 55 as lift line 14 becomes further tensioned. This tension causes spring 55 to compress and store energy to counteract rotation of vehicle 20 as discussed hereinbefore in reference to FIG. 6.

Figure 4D:
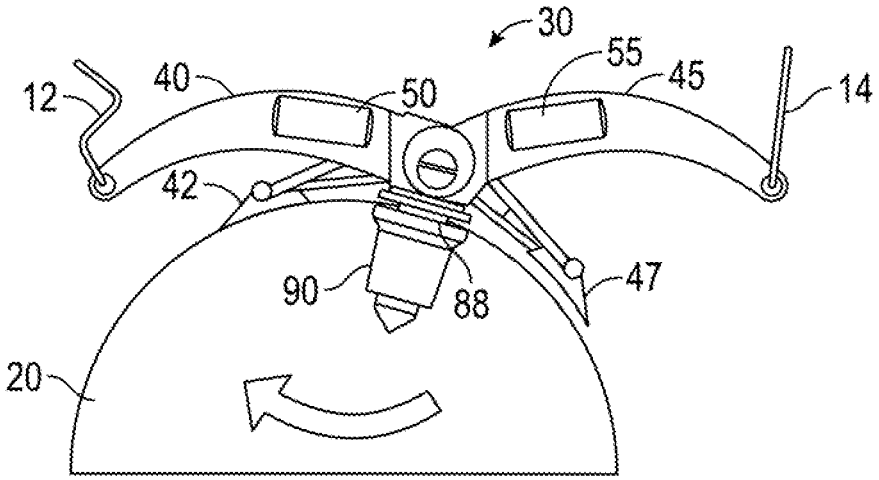
FIG. 4D is a cross-sectional diagram showing a water vehicle with attached pivoting lifting device with approximately fifteen degrees of roll in the direction of the arrow and pad contact with partial spring compression in accord with one possible embodiment of the present invention.

FIG. 4D depicts vehicle 20 in an approximately fifteen degree roll. As the degree of the roll experienced by vehicle 20 increases, vehicle 20 will push against pad 42 with greater pressure and the tension will gradually increase on lift line 14; however, the countering force of spring 55 will also gradually increase and resist the roll of vehicle 20.

It will be noted that if the roll was initiated in the opposite direction than that depicted by the arrow in FIG. 4B, the descriptions above would hold true, except lift line 12 would be the line experiencing tension and pad 47 would initiate contact with vehicle 20.

In FIG. 7, a side view is shown of lifting device 10 mounted to vehicle 20. Vehicle capture portion 15 comprises single point vehicle connection 90, which preferably is positioned near the center of gravity of vehicle 20 when the vehicle is captured.

Figure 8:
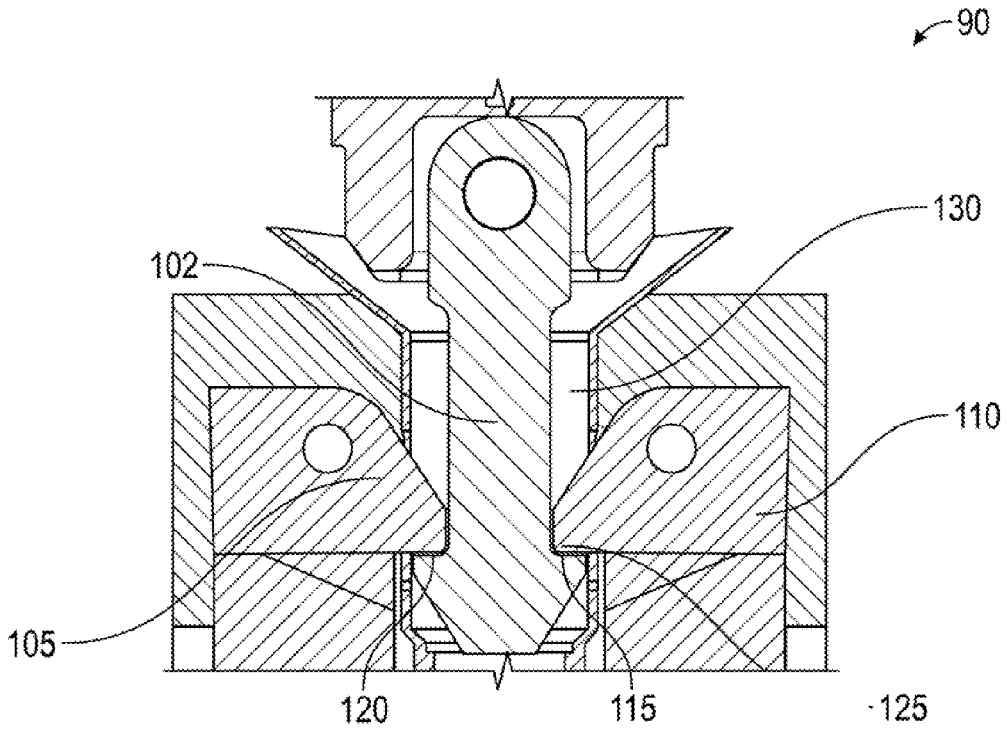
FIG. 8 is an elevational view, in section, of the mechanism for attachment to the water vehicle for the capture portion of the pivoting lifting device engaged with the water Vehicle as depicted in FIG. 7 in accord with one possible embodiment of the present invention.

FIG. 8 further depicts the details of one possible embodiment of single point vehicle connection 90 that is used to secure lifting device 10 to vehicle 20. The invention is not limited to any particular connection or mounting to connect lifting device 10 to vehicle 20 and may utilize prior art single point vehicle connections that have been used to mount rigid frames to vehicles. In this embodiment, only a single point connection is provided between lifting device 10 and vehicle 20. Probe 102 (see FIG. 8) is secured to an underside of vehicle capture portion 15 as shown in FIG. 7. Referring to FIG. 8, probe 102 is inserted into latch opening 130 in vehicle 20. Latch opening 130 is defined by first pawl 105 on one side and second pawl 110 on a side opposite first pawl 105. Probe 102 further comprises shoulders 120, 115 which make contact with pawls 105, 110 respectively, after probe 102 is inserted into latch opening 130. This connection secures vehicle 20 to lifting device 10 for safe recovery.

Accordingly, as discussed hereinbefore, the present invention prevents and/or significantly reduces the possibility of snap-line loading that was present with previous lifting devices. Pivotal lifting device 10 with spring loading eliminates snap-line loading between vehicle 20, vehicle lift device 10, and lift lines 12, 14.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A lifting device for a multi-point lift line configuration to capture a vehicle from the water, comprising:

a vehicle capture portion, said vehicle capture portion comprising a capture connector operable to secure said vehicle capture portion to the vehicle;

a lifting arms portion comprising two lifting arms each connectable with at least one lift line, at least two vehicle pads mounted to said lifting arms portion, said at least two vehicle pads being positioned on said lifting arms portion for engagement with the vehicle, and at least one spring operably connected between at least one of said two lifting arms and said vehicle capture portion, each of said at least two vehicle ads being mounted for relative movement with respect to each other and with respect to each of said two lifting arms, said vehicle capture portion and said lifting arms portion being axially aligned with respect to each other along a single axis; and a pivot connection between said vehicle capture portion and said lifting arms portion that permits rotation only around said single axis.

2. The lifting device of claim 1, wherein said capture connector further comprises a probe mounted to said vehicle capture portion that extends outwardly from said vehicle capture portion at a position for engaging said vehicle, said two lifting arms being rigidly secured together to prevent relative movement between said two lifting arms.

3. The lifting device of claim 1, wherein said vehicle capture portion further comprises at least one lift line connection point positioned at a distal end from said pivot connection, said at least one lift line connection point being operable for connection with at least one lift line of the multi-point lift line configuration.

4. The lifting device of claim 3, wherein said two lifting arms, said at least one spring, and said connection point are positioned to compress said spring in response to roll of the vehicle when said capture connector secures said vehicle capture portion to the vehicle.

5. The lifting device of claim 1, wherein said two lifting arms are positioned to extend outwardly from the vehicle on opposite sides of the vehicle when said capture connector secures said vehicle capture portion to the vehicle.

6. The lifting device of claim 1, wherein said pivot connection permits relative rotation between said vehicle capture portion and said lifting arms portion around a single axis.

7. The lifting device of claim 6, wherein said vehicle capture portion is elongate along said single axis.

8. A lifting device for a multi-point lift line configuration to capture and lift a vehicle from the water, comprising:

an elongate vehicle capture portion having a longitudinal axis, proximal and distal ends, and at least one lift line connection point at said distal end;

a capture connector coupled to and extending from said vehicle capture portion, said capture connector having a probe extending therefrom that is operable for insertion into a latch opening on a topside of the vehicle and for engaging a locking mechanism therein;

a lifting arm portion comprising two lifting arms, each said lifting arm having at least one lift line connection point at a distal end thereof, said vehicle capture portion and said lifting arms portion being axially aligned with respect to each other along a single axis;

a vehicle pad coupled to each said lifting arm, each said vehicle pad being positioned for engagement with the vehicle when the vehicle is engaged by said capture connector;

a pivot connection disposed between and coupled to said lifting arms portion and said vehicle capture portion at said proximal end, wherein said pivot connection enables said lifting arms portion to rotate only about said longitudinal axis with respect to said vehicle capture portion; and at least one spring having one end coupled to one of said lifting arms and another end coupled to said vehicle capture portion proximate to said pivot connection, said at least one spring being operable to resist rotation of said lifting arms portion about said longitudinal axis.

9. The lifting device of claim 8, wherein said at least one spring comprises two springs, and wherein one said spring is coupled to one said lifting arm and the other said spring is coupled to the other said lifting arm, each said vehicle pad being mounted so that a first vehicle load is compressed against the vehicle and a second vehicle pad is released from compression against the vehicle when the vehicle rolls.

* * * * *